United States Patent [19]

Adkins

[11] 4,446,692

[45] May 8, 1984

[54] FLUIDIC CONTROL OF AIRFLOW IN COMBUSTION CHAMBERS

[75] Inventor: Richard C. Adkins, Milton Keynes, England

[73] Assignee: Rolls-Royce Limited, London, England

[21] Appl. No.: 62,418

[22] Filed: Jul. 31, 1979

Related U.S. Application Data

[63] Continuation-in-part of Ser. No. 827,109, Aug. 23, 1977.

[30] Foreign Application Priority Data

Sep. 9, 1976 [GB] United Kingdom ..... 37326/76

[51] Int. Cl.[3] ..... F02C 7/057

[52] U.S. Cl. ..... 60/39.23; 60/759

[58] Field of Search ..... 60/39.23, 752, 759

[56] References Cited

U.S. PATENT DOCUMENTS

| | | | |
|---|---|---|---|
| 2,788,702 | 4/1957 | Baum, Jr. | 356/340 |
| 3,577,878 | 5/1971 | Greenwood | 60/39.23 |
| 3,631,675 | 1/1972 | Keiter | 60/39.23 |
| 3,910,035 | 10/1975 | Jahasz et al. | 60/39.23 |
| 4,062,182 | 12/1977 | Fehler | 60/733 |
| 4,150,360 | 4/1979 | Kopp et al. | 356/539 X |
| 4,303,616 | 12/1981 | Kano et al. | 422/73 X |

OTHER PUBLICATIONS

Adkins, R. C., "Short Diffuser with Low Pressure Loss", *Journal of Fluids Eng.*, Sep. 1975, pp. 297–302.
Blume et al., *Clin. Chem.*, 21/9, 1234–1237, (1975).
Stull, *Clin. Chem.*, 19/8, 883–890, (1973).
Kaye et al., *J. Phys. E: Sci. Instrum.*, vol. 12, No. 8, Aug. 1979.

*Primary Examiner*—Carlton R. Croyle
*Assistant Examiner*—Jeffrey A. Simenauer
*Attorney, Agent, or Firm*—Cushman, Darby & Cushman

[57] ABSTRACT

The airflow from the compressor of a gas turbine engine into the combustion chamber or chambers principally comprises combustion air which enters the upstream end of the combustion chamber and dilution air which enters the combustion chamber at some point downstream of the combustion chamber inlet, the combustion air being made up of primary and secondary air entering the combustion chamber primary and secondary zones.

In order to cope with the control of emissions from the combustion chambers, it is desirable to control the combustion air fuel ratio over the engine operating range by controlling air mass flow to the combustion and dilution zones of the combustion chamber. The invention proposes that this control can be achieved by providing a variable rate diffuser upstream of the primary, secondary and dilution air inlets, the variable rate diffuser comprising vortex generator having an associated variable air bleed. The air bleed functions to control the strength of the generated vortex which in turn controls the rate of diffusion of the air supply to the combustion chamber.

4 Claims, 4 Drawing Figures

FLUIDIC CONTROL OF AIRFLOW IN COMBUSTION CHAMBERS

Figure 1:
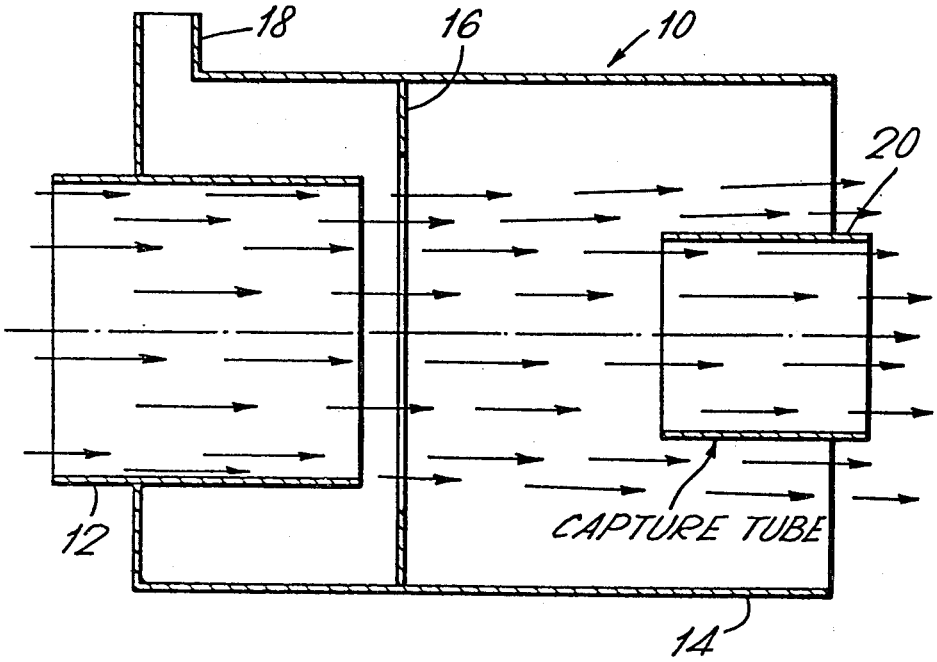

This application is a continuation-in-part application of U.S. application Ser. No. 827,109, filed Aug. 23, 1977.

This invention relates to the control of airflow in gas turbine engine combustion chambers by the use of a fluidic flow control device known as a vortex flow controlled diffuser, for the purpose of controlling most of the visible and invisible exhaust pollutants, particularly emissions of carbon monoxide (CO) and oxides of nitrogen ($NO_x$).

The supply of air to the combustion chamber from the engine compressor is usually divided into two main flows, namely (one) combustion air which is fed to the primary and secondary zones known collectively as the combustion zone of the chamber through a series of apertures in the upstream end of the chamber and is known as primary and secondary air, and (two) dilution air which is fed into the chamber through another series of apertures in the downstream end of the chamber, the purpose of which is to cool the hot gases from the combustion zone to a temperature acceptable to the turbine and also such that the gases are at a reasonably uniform temperature throughout. A small proportion of the compressor delivery air may also be used for cooling the combustion chamber walls and the blades of the high pressure turbine. All of the combustion air must be supplied at a pressure adequate for sufficient penetration into the flow in the combustion chamber to ensure proper mixing and uniform combustion.

The sources of pollutants in such combustion chambers are directly related to the temperature-time composition histories of all the fluid elements in the combustion chamber. Carbon monoxide (CO) is a product of incomplete combustion, formed in substantial quantities in the combustion primary zone. CO undergoes oxidation to $CO_2$ in the primary and secondary zones and this rate-limited step greatly influences the concentration of CO in the exhaust gases. CO emissions are at their maximum at low power conditions when the combustor is operating close to the weak extinction limit, the bulk temperatures are low, and the oxidation rates are slow. The presence of hydrocarbons (HC) in the exhaust is due largely to unburnt fuel and partially oxidised products which find their way into the cooling films within the combustor liner and like CO, these emissions are also at their highest at low power conditions.

Engine smoke which is mostly carbon, is formed in the primary zone in fluid elements with rich fuel-air ratios and consequently are at a maximum at high power conditions. The oxides of nitrogen which comprise mostly nitric oxide (NO) are formed in the high temperature regions of the primary and secondary zones, and in fluid elements with equivalence ratios near unity, their formation rate being characterised by a very strong dependence upon temperature, equivalence ratio being defined as the ratio of fuel to air fractions between the operational and the stoichiometric conditions. Clearly an equivalence ratio of less than unity denotes an air excess and vice-versa. The reconversion process of NO to $N_2$ and $O_2$, once formed, is relatively slow and it remains in the exhaust gases where it is also most prevalent at high power conditions when the bulk temperatures are maximum.

In summary, some pollutants such as CO are formed at low power conditions whilst other pollutants such as smoke and $NO_x$ are formed at high power conditions and in conventional combustion systems, methods of reducing CO tend to increase the amounts of $NO_x$ and vice-versa. For example, a convenient way of reducing the maximum temperature and therefore the formation of $NO_x$, a problem which is acute in high pressure ratio engines where the combustion temperature is increased by the higher temperature of the supply air, is to operate the combustion primary zone at an off-stoichiometric mixture strength, since the formation of $NO_x$ is at a maximum when the air and fuel mixture is stoichiometric and decreases rapidly as the mixture is richened or weakened. Thus $NO_x$ can be reduced provided the equivalance ratio is greater than 1.2 (fuel rich) or less than 0.8 (fuel weak) and because the fuel rich solution leads to a large combustion chamber which means extra weight and volume, it is necessary to take the fuel weak solution for aero-engines and their industrial derivatives.

However, this solution leads to a further problem, because when the engine operates at a part load condition there is a tendency for the equivalence ratio and the compressor delivery air temperature to drop causing the emission of large quantities of CO and the likelihood of combustion instability.

A solution to this problem is to control the air: fuel ratios in the flame tube to suit the varying operating conditions. In this way the best compromise between combustion efficiency and the production of exhaust gas pollutants, and exit temperature can be achieved. This desirable state is achievable, either by the method known as fuel staging or by the method of controlling the division of the air entering the various zones of the flame tube (hereinafter referred to as regional control of air). The practice of fuel staging of which the U.S. Pat. No. 4,062,182 to Fehler et al is but one example. involves the placing of air: fuel mixtures of known ratios into selected portions of the combustion zone. It usually involves at least two independently controllable stages of fuel injectors and a corresponding number of groups of air and fuel inlets into the combustion zone for the passage of two or more independent air and fuel mixture flows. By this method the combustion zone can be divided up into a first portion in which the air: fuel mixture is fuel rich as required for good ignition, the engine starting cycle and the lean mixture stalling limit and a second portion in which the air and fuel mixture is air rich to provide the lower combustion temperature. The net result of this arrangement is to achieve the desired lower bulk combustion temperatures and so keep the $NO_x$ emissions at an acceptable level whilst still being able to operate at low power conditions without generating substantial quantities of CO. The disadvantage of such an arrangement is the complexity of the fuel supply, in that at least two separately controllable fuel supply systems are required each having to be able to be assembled and dis-assembled with respect to the combustor and requiring relatively large apertures in the engine casing for such purposes. This duplicity of fuel injectors can be avoided by the use of regional control of air supply.

The principle of the regional control of air which is illustrated in the U.S. Pat. No. 3,631,675 to Keiter et al, involves the use of a single fuel supply system. The air supply to the flame tube, in particular the primary zone, is controlled over the operating range to vary the air:

fuel ratio in the primary zone, in this case to reduce smoke. The air supply control can be by mechanically variable geometry as shown in the U.S. Pat. No. 3,677,878, to Greenwood et al, or the use of high-pressure counterflow air injection to direct the main air stream which enters the combustor, or the use of a bleed in the combustor inlet to induce more or less air as required to enter the combustion zone of the combustor, as shown in the aforementioned Keiter et al patent. Referring particularly to FIG. 5 of that patent there is shown a combustion chamber 14 of the annular type, the coannular type or the cellular type having a conventional spray atomising fuel air injector 90 and a bleed manifold 92 in fluidic flow cooperation with a passage 94 upstream of the centre passage 32" and downstream of the engine compressor 28. The manifold is operated by a valve 96 to vary the amount of air passing to the passage 32" and therefore, the air flowing to the outer passage 22" since at a given engine operating condition, the mass flow from the compressor is constant. It is also suggested that the air flow to the inner passage 24" could be controlled by a similar manifold and valve arrangement. This system operates as a fluidic direction control to induce the air supply to flow into either or both of the passages 22", 24". The air passing down the passages 22" or 24" flows into the secondary and intermediate portions of the combustion zone and the dilution zone of the combustor. This system is susceptible to instability since if the bleed induces more air to flow into either or both of the passages 22", 24" than either passage can accept, then a back pressure will build up and the flow will take the path of least resistance and the flow could alternate between the passages 22", 24", e.g. the bleed could be as a fluidic 'flip-flop'. It has been found that when using a similarly arranged combustor but with a vortex controlled air diffuser as disclosed in a paper 'A Short Diffuser with Low Pressure Loss' by the present inventor, in the "Journal of Fluids Engineering", September 1975 in place of the manifold 92 and valve 96 of Keiter et al, the secondary as well as the dilution air does not have sufficient energy to penetrate the flow in the combustor to achieve efficient conbustion and ensure that the hot gases from the combustion zone can be both cooled to a suitable temperature for the turbine and have a uniform temperature profile at the combustor outlet.

The present invention has for its objective, a gas turbine engine combustion chamber in which the fuel is injected from a single fuel injector as opposed to the multiplicity of fuel injectors disclosed in U.S. Pat. No. 4,062,182, the air:fuel ratios to selected zones of the combustion chamber being controlled by the vortex controlled air diffuser referred to above and means are provided to ensure that both secondary and dilution air can adequately penetrate the hot gases from the combustion zone for the purposes outlined above.

Accordingly the present invention provides a gas turbine engine combustion apparatus having fluidic means for varying the air flow to the combustion apparatus to control the air:fuel ratio over an operating range of the gas turbine engine, said apparatus comprising;

a variable rate vortex controlled diffuser including a primary duct for receiving a supply of air and having an exit end for discharging the same, a secondary duct surrounding the exit end of said primary duct, a fence in said secondary duct positioned downstream of the exit end of said primary duct for generating a vortex to diffuse a portion of the air discharging from said primary duct, a bleed duct communicating with said secondary duct upstream of said fence and of said exit end of said primary duct for controlling the vortex and a capture tube positioned within said secondary duct and spaced downstream of said fence for receiving a portion of the air directly from said primary duct;

a combustion chamber defined by a casing and having a first air inlet means at its upstream end for receiving as primary air a portion of the air from said capture tube, a second air inlet means positioned downstream from said first air inlet means for receiving secondary air, and a third air inlet means positioned downstream from said second air inlet means for receiving dilution air; said first air inlet means including an opening at the upstream end of said combustion chamber for receiving directly air discharged from said capture tube;

a second casing attached to said capture tube and extending downstream therefrom around a part of the combustion chamber casing and also attached to the combustion chamber casing, said second casing defining with the combustion chamber casing, a first annular housing for directly receiving a portion of the air discharged from said capture tube, and delivering it as secondary air to said combustion chamber said second air inlet means comprising downstream openings in the combustion chamber casing providing communication between said combustion chamber and said first annular housing;

a third casing attached to said secondary duct of said variable rate vortex controlled diffuser, said third casing extending from said secondary duct downstream around said second casing and a portion of the combustion chamber casing and attached thereto, said third casing defining with said second casing and the combustion chamber casing a second annular housing for receiving diffused air into said combustion chamber, said third air inlet means including openings in the casing of said combustion chamber providing communication between said combustion chamber and one of said first and second annular housing; and a unified fuel injection apparatus having a circumferential array of fuel injectors in which at each circumferential position, a single fuel injector is located at the upstream end of the combustion chamber adjacent the first air inlet means.

The unified fuel injection apparatus will comprise in the case of an annular combustion apparatus having a single annular combustion chamber, a circumferential array of equi-spaced fuel injectors located at the upstream end of the combustion chamber and in the cases of cannular and can type combustion apparatus, each cylindrical combustion chamber has a single fuel injector located at its upstream end adjacent the first air inlet means.

For some designs of combustion chamber, it may be necessary to extend the second casing to include the dilution air inlets to ensure that dilution air has sufficient energy to penetrate the combustion gases to cool those gases and create a substantially uniform temperature at the combustion chamber outlet. In which case, bypass holes will need to be provided in the combustion chamber casing to give communication between the combustion chamber and the second annular housing, to enable the diffused air to flow an alternative route.

Figure 2:
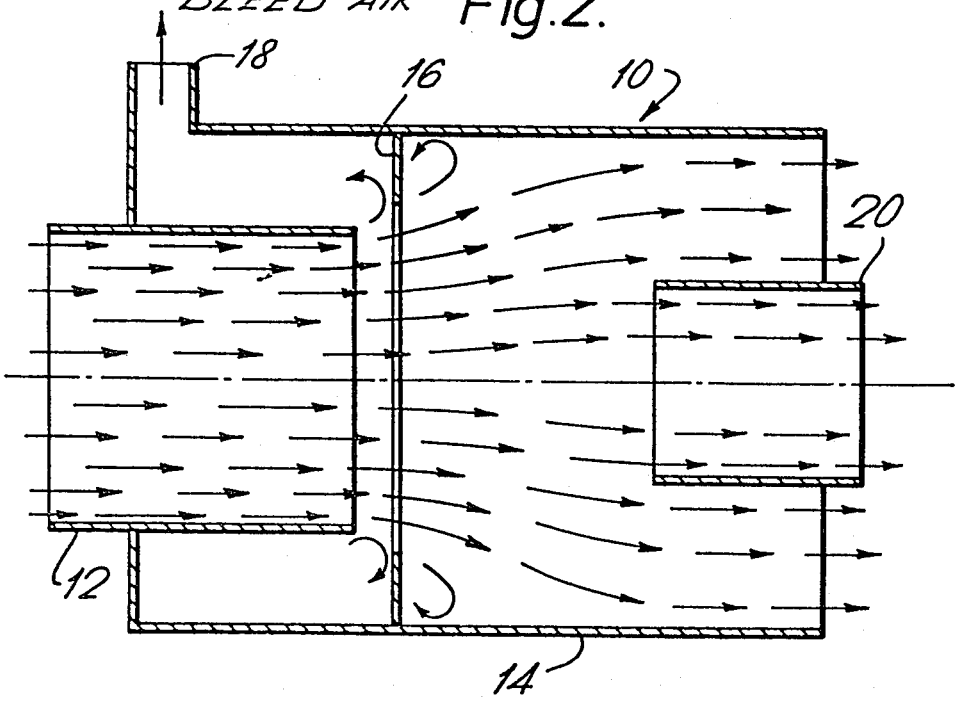
Figure 3:
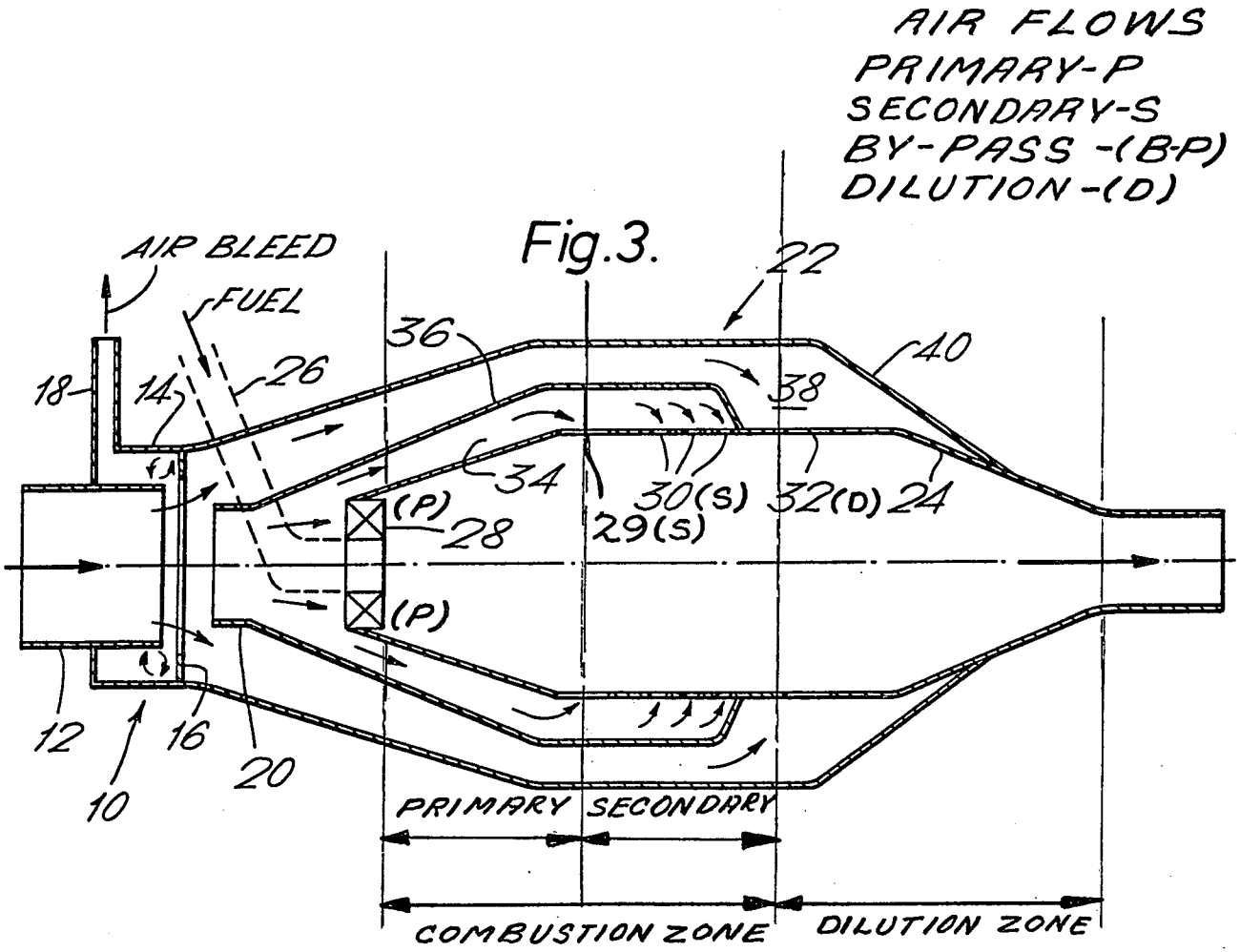
Figure 4:
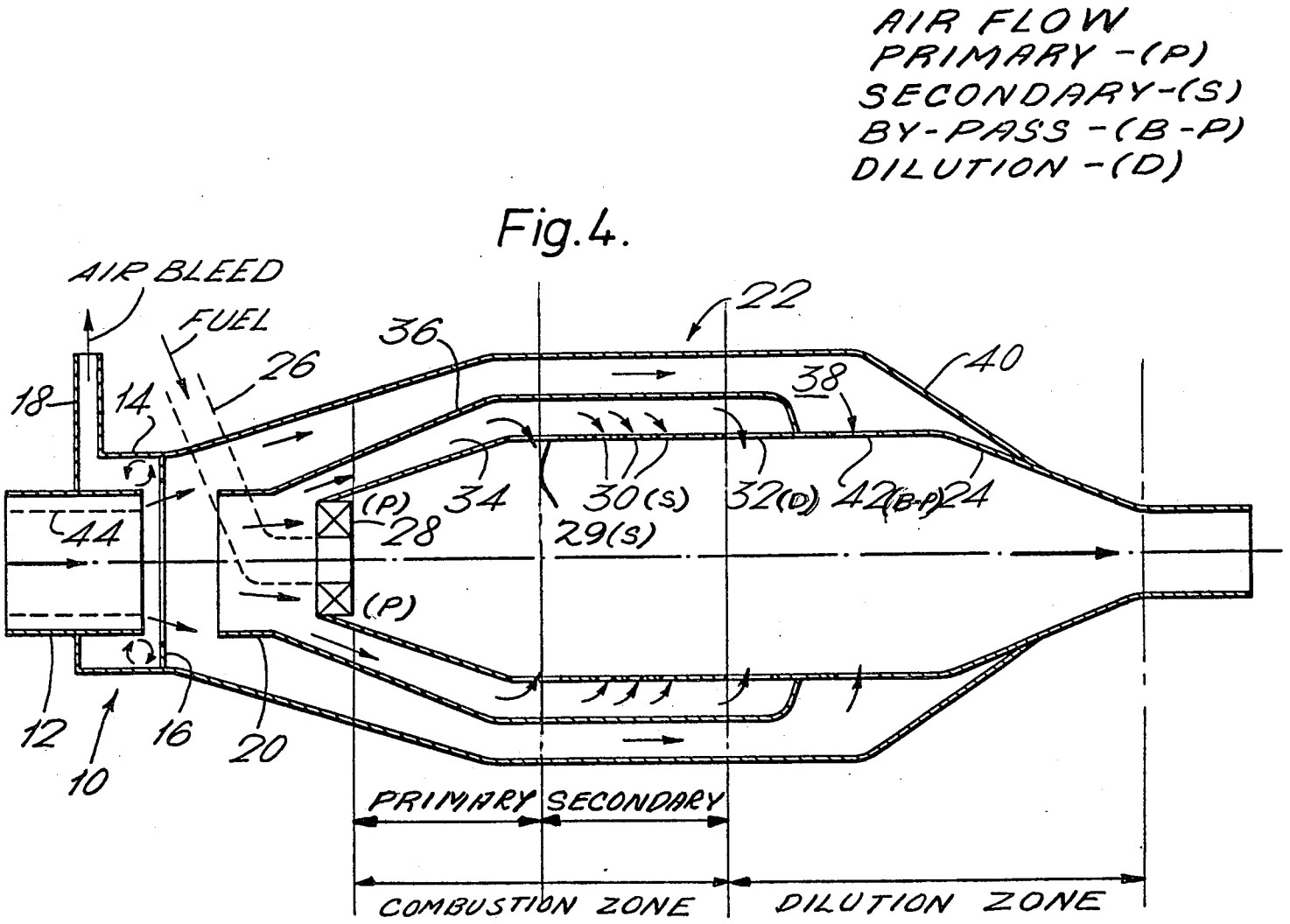

The present invention will now be more particularly described with reference to the accompanying drawings in which:

FIG. 1 is a diagrammatic representation of a variable rate vortex controlled diffuser, operating without bleed, FIG. 2 is a diagrammatic representation of a variable rate vortex controlled diffuser operating with bleed, FIG. 3 shows one form of combustion chamber according to the present invention, and FIG. 4 shows a further form of combustion chamber according to the present invention.

Referring to FIGS. 1 and 2 a vortex controlled variable rate regulated diffuser 10 comprises a primary duct 12 located in a secondary duct 14, an annular fence 16 fixed in the secondary duct downstream of the outlet of the primary duct and a bleed duct 18 in the secondary duct 14. A capture tube 20 is positioned in the secondary duct 14 to receive air from the primary duct 12 and together with the secondary duct 14 forms part of the combustion apparatus shown in FIGS. 3 and 4.

In FIG. 1, no air is bled through bleed duct 12, and the jet of air leaving the primary duct 12 is partially recaptured by the tube 20 which is smaller in diameter than the primary duct 12. The fraction of air captured is determined mainly by the diameter of the capture tube. In FIG. 2, the jet of air from the primary duct 12 is diffused rapidly by applying a small bleed flow through duct 18 which causes the jet of air to diffuse so that the tube 20 receives significantly less of the flow. By varying the amount of bleed flow, the rate at which the jet of air diffuses can be varied thereby varying the amount of air which flows through the tube 20 and the air which spills around the outside of the tube 20.

Referring to FIG. 3, the diffuser 10 is attached to combustion apparatus 22 which comprises a combustion chamber defined by a casing 24 having a fuel supply 26, in the form of a fuel injector, a primary air inlet 28, e.g. a ring of swirler vanes, secondary air inlet 29, 30 respectively and dilution air inlets 32. A first annular housing 34 formed by a casing 36 around part of the combustion chamber casing 24, is attached to the capture tube 20 and encloses the primary and secondary air inlets 28, 29 and 30 respectively. A second annular housing 38 is formed by a casing 40 surrounding the casing 36 and including the dilution air inlet 32, the casing 40 being attached to the secondary tube 14 and the downstream end of the casing 24.

The interior of the combustion chamber can be divided into two zones, a combustion zone in which the fuel is burnt and a dilution zone in which the hot combustion gases are cooled by the incoming dilution air which also assists in creating a substantially uniform temperature profile at the combustion chamber outlet. The combustion zone may be divided up in the direction of flow through the combustion chamber into primary and secondary zones, and the primary zone being fed with air through the inlet 28 and by part of the secondary air flowing through the apertures 29, the secondary zone being fed with the remaining air flowing through the apertures 29 and the air through the apertures 30.

A description of the vortex controlled diffuser and the manner of operation appears in the aforementioned paper "A Short Diffuser with Low Pressure Loss".

With the arrangement in FIG. 3, results of tests on a model combustion chamber operating under cold flow conditions, show that the pressure drop across the casing 24 in the region of the inlets 29, 30 both at full power and at idling will be sufficient for penetration purposes. In the downstream region, the pressure drop across the casing in the region of the dilution air inlet 32 will always be less than the pressure drop across the upstream inlets due to the parasitic loss across the diffuser 10. The area ratio between the dilution inlets 32 and the inlets 29, 30 is also a factor in determining the pressure drop across the inlets 32. In some applications the pressure drop across the inlets 32 is inadequate for the dilution air both to cool and penetrate the combustion gases to the required degree, to create a substantially uniform temperature profile.

This problem can be overcome by grouping dilution air inlets 32 with the secondary air inlets 29, 30 so that they are fed directly from the capture tube 20 as shown in FIG. 4. In doing this it is necessary to extend the casing 36 to incorporate a further row of holes 42 which can be termed bypass ports. The pressure drop across the ports 42 is unimportant since the air flow through them does not participate in the combustion and dilution process proper apart from its effect in controlling the flow distribution, e.g. the proportioning of the air flows to the annular housings 34 and 38.

At full engine power, significantly all the air will be taken by the upstream region e.g. through the inlets 28, 29, 30 and 32 and only sufficient air for ventilation purposes will flow through the bypass holes.

In the FIG. 4 arrangement, the pressure drops experienced by both the combustion air and dilution air will fall equally when the combustor operating mode is switched from full power to idle. An important feature of the arrangement is that the pressure drop available is not reduced at the critical full power condition, i.e. both the dilution air and the combustion air having sufficient energy to promote combustion and dilution quality.

The parasitic pressure loss due to the regulated diffuser 10 will tend to decrease the relatively unimportant pressure drop across the bypass ports 42, but it will be necessary to ensure that there is sufficient pressure drop to provide a flow through the annular housing 38 so that the gases in the combustion chamber cannot flow out through the ports 42. The ventilating flow can be arranged to cool the downstream part of the casing 24.

A further modification is also shown in FIG. 4 in the form of a primary duct 44 which is smaller in diameter than the capture tube 20 and this enables a smaller bleed flow to be used for a given flow through the housing 34.

With the two combustion chamber arrangements described above and in particular that in FIG. 4, it has been shown that the variable rate vortex controlled diffuser can be used to obtain a variation in primary zone equivalence ratio from about 1.0 at engine idling down to about 0.70 at full power. Because the equivalence ratio is relatively low at full power the air:fuel ratio is fuel weak and the operating temperature will be reduced, thereby reducing $NO_x$ emissions.

At the engine idling condition, the equivalence ratio is adjusted to about 1.0 which corresponds to a stoichiometric air:fuel ratio. This ensures that a sufficiently high temperature to fully complete the combustion process so the quantities of CO generated are reduced and the likelihood of combustion instability also reduced. Although there is a tendency for the temperature to increase because of the air:fuel ratio, the temperature of the compressor delivery air is lower and the combustion temperature at idle is not sufficient to generate unacceptable quantities of $NO_x$.

Other advantages are as follows: that the regulated diffuser 10 generates no additional parasitic pressure loss to the combustion system; it has an almost linear controlability characteristic, e.g. the percentage of air entering the combustion zone varies almost linearly with the percentage bleed through duct 18; the pre-combustor diffusion of the supply air may be possible in a short length, and in efficient manner, thereby enabling the device to be fitted to existing engines with little or no increase in overall length; and the device eliminates the need for numerous fuel injectors, as required by the alternative staged fuel system.

Although the arrangement according to the invention requires a small amount of supply air to be bled off, this only occurs at low power conditions. This can in fact, be beneficial as the bleed will increase combustion temperatures because the turbine has to operate at a lower mass flow.

I claim:

1. A gas turbine engine combustion apparatus having fluidic means for varying the air flow to the combustion apparatus to control the air:fuel ratio over an operating range of the gas turbine engine, said apparatus comprising;

a variable rate vortex controlled diffuser including a primary duct for receiving a supply of air and having an exit end for discharging the same, a secondary duct surrounding the exit end of said primary duct, a fence in said secondary duct positioned downstream of the exit end of said primary duct for generating a vortex to diffuse a portion of the air discharged from said primary duct, a bleed duct communicating with said secondary duct upstream of said fence and of said exit end of said primary duct for controlling the vortex, and a capture tube positioned within said secondary duct and spaced downstream of said fence for receiving a portion of the air directly from said primary duct;

a combustion chamber defined by a casing and having an outlet at its downstream end, a first air inlet means at its upstream end for receiving as primary air a portion of the air from said capture tube, a second air inlet means positioned downstream from said first air inlet means for receiving secondary air, and a third air inlet means positioned downstream from said second air inlet means for receiving dilution air, said first air inlet means including an opening at the upstream end of said combustion chamber for receiving directly air discharged from said capture tube;

a second casing attached to said capture tube and extending downstream therefrom around a part of said combustion chamber casing, said second casing defining with said combustion chamber casing a first annular housing for directly receiving a portion of the air discharged from said capture tube, and delivering it as secondary air unmixed with fuel to said combustion chamber through said second air inlet means which comprise downstream openings in said combustion chamber casing providing communication between said combustion chamber and said first annular housing to direct the secondary air transversely of and into said chamber to insure proper mixing and promote further uniform combustion;

a third casing attached to said secondary duct of said variable rate vortex controlled diffuser, said third casing extending from said secondary duct downstream around said second casing and a portion of said combustion chamber casing and attached thereto, said third casing defining with said second casing and said combustion chamber casing a second annular housing for receiving diffused air and delivering it into said combustion chamber, said third air inlet means including openings in said combustion chamber casing providing communication between said combustion chamber and one of said first and second annular housings to direct the dilution air transversely of and into said combustion chamber for penetrating and cooling the hot combustion gases therein and for creating a substantially uniform temperature profile for such gases at said combustion chamber outlet; and a unified fuel injection apparatus having a circumferential array of fuel injectors in which at each circumferential position, a single fuel injector is located at the upstream end of said first air inlet means.

2. A combustion apparatus as defined in claim 1 in which the third air inlet means provides communication between the combustion chamber and the first annular housing.

3. A combustion apparatus as defined in claim 1 in which the third air inlet means provides communication between the combustion chamber and the second annular housing.

4. A combustion apparatus as defined in claim 1 in which the diameter of the primary duct is less than the diameter of the capture tube.

* * * * *